United States Patent [19]

Gordon

[11] Patent Number: 4,720,098

[45] Date of Patent: Jan. 19, 1988

[54] EXERCISER WITH BEVERAGE RESERVOIR

[75] Inventor: Hy S. Gordon, Plantation, Fla.

[73] Assignee: Hydrocizer Industries, Inc., Fla.

[21] Appl. No.: 888,138

[22] Filed: Jul. 23, 1986

[51] Int. Cl.[4] ..... A63B 11/00

[52] U.S. Cl. ..... 272/122; 272/143; 206/315.1

[58] Field of Search ..... 272/68, 93, 116, 117, 272/119, 122, 123, 128, 130, 143; 222/192, 552; 206/315.1; D21/197; D9/378, 383

[56] References Cited

U.S. PATENT DOCUMENTS

| | | | |
|---|---|---|---|
| 814,570 | 3/1906 | Stockdell | 272/122 |
| 3,334,899 | 8/1967 | Bosko et al. | 272/122 |
| 4,076,236 | 2/1978 | Ionel | 272/123 |
| 4,089,528 | 5/1978 | Green | 272/122 |
| 4,103,887 | 8/1978 | Shoofler | 272/123 |
| 4,199,140 | 4/1980 | Ferretti | 272/123 |
| 4,229,015 | 10/1980 | Ramsey et al. | 222/552 X |
| 4,361,324 | 11/1982 | Baroi | 272/123 |
| 4,575,074 | 3/1986 | Damratoski | 272/119 |
| 4,627,618 | 12/1986 | Schwartz | 272/122 |
| 4,651,988 | 3/1987 | Sobel | 272/122 X |

FOREIGN PATENT DOCUMENTS

| | | | |
|---|---|---|---|
| 21900 | of 1903 | United Kingdom | 272/122 |

*Primary Examiner*—Richard J. Apley
*Assistant Examiner*—Robert W. Bahr
*Attorney, Agent, or Firm*—Antonelli, Terry & Wands

[57] ABSTRACT

A dumbbell-shaped hand held exerciser has a tubular central section formed as a drink reservoir and screw-on end caps of different weights enabling the overall weight of the device to be varied dependent on the end caps selected for use with the central section. The central section may include a drinking valve and the device has a U-shaped handle member with a removable moisture absorbent cover.

17 Claims, 3 Drawing Figures

EXERCISER WITH BEVERAGE RESERVOIR

BACKGROUND AND SUMMARY OF THE INVENTION

Field of the Invention

This invention relates to a dumbbell-like hand held exercising device of the type that may be used while running or performing other physical exercise. It has become increasingly popular for runners to carry weighted dumbbells in the hands while running in order to provide an additional aerobic exercising facility.

The present invention provides a dumbbell-like exercising device which may be used during running or other activities, which provides a reservoir for water or other beverage without affecting the overall size or appearance of the device, and which has the facility for adjusting the weight of the device independently of the amount of liquid in the reservoir.

In accordance with the invention, an exercising device comprises a central tube-like member defining a drink reservoir, the tube-like member having threaded female ends, and the device further including a series of ball-shaped end caps of varying weight with complementary threads for fitting on the respective ends of the tubular member. The tubular member can be used as a reservoir for containing drinking water or other beverage, the reservoir being filled through one end, and the overall weight of the device can be adjusted by selective use of end caps of a preferred weight. The end caps may, for example, be supplied in a variety of weights from one pound up to six pounds in one pound intervals. The reservoir may be provided with a drinking valve so that an end cap does not have to be removed when liquid is required from the reservoir.

The device may have a U-shaped handle extending from the tubular member and a terrycloth or like removable cover for the handle which can be used, for example, as a perspiration absorber.

Applicant is aware of the following U.S. patents pertaining to exercise devices, liquid containers and the like.

| | |
|---|---|
| 907,965 | 12/29/08 |
| 1,066,200 | 1/18/21 |
| 4,029,312 | 6/14/77 |
| 4,076,236 | 2/28/78 |
| 4,079,932 | 3/21/88 |
| 4,199,140 | 4/22/80 |
| 4,229,015 | 10/21/80 |

The patents to Schuetz, Ferretti, Wright and Ionel show exercising devices formed with liquid containers primarily intended for adjusting the weight of the respective device. The patent to Ramsey shows a ski pole with a container specifically intended for a beverage. None of the patents discloses a hand-held exerciser of the type contemplated by the present invention having a combination of a liquid container with separate adjustable weights which may form into caps for the container, whereby the weight of the device can be adjusted independently of the quantity of liquid present in the container.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
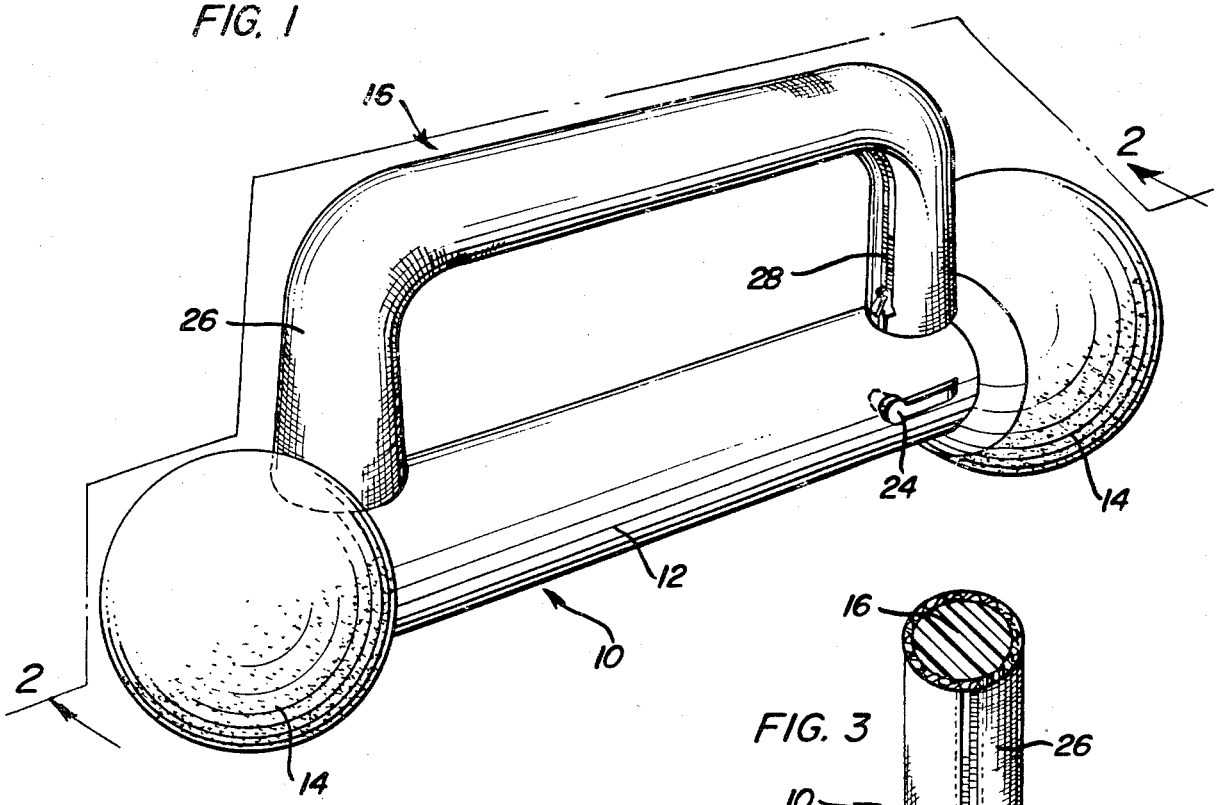
FIG. 1 is a perspective view of an exercise device in accordance with the invention.
Figure 3:
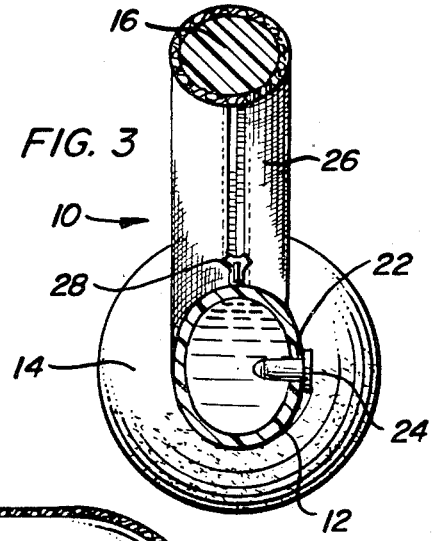
FIG. 3 is a sectional view on line 3—3 of FIG. 2.
Figure 2:
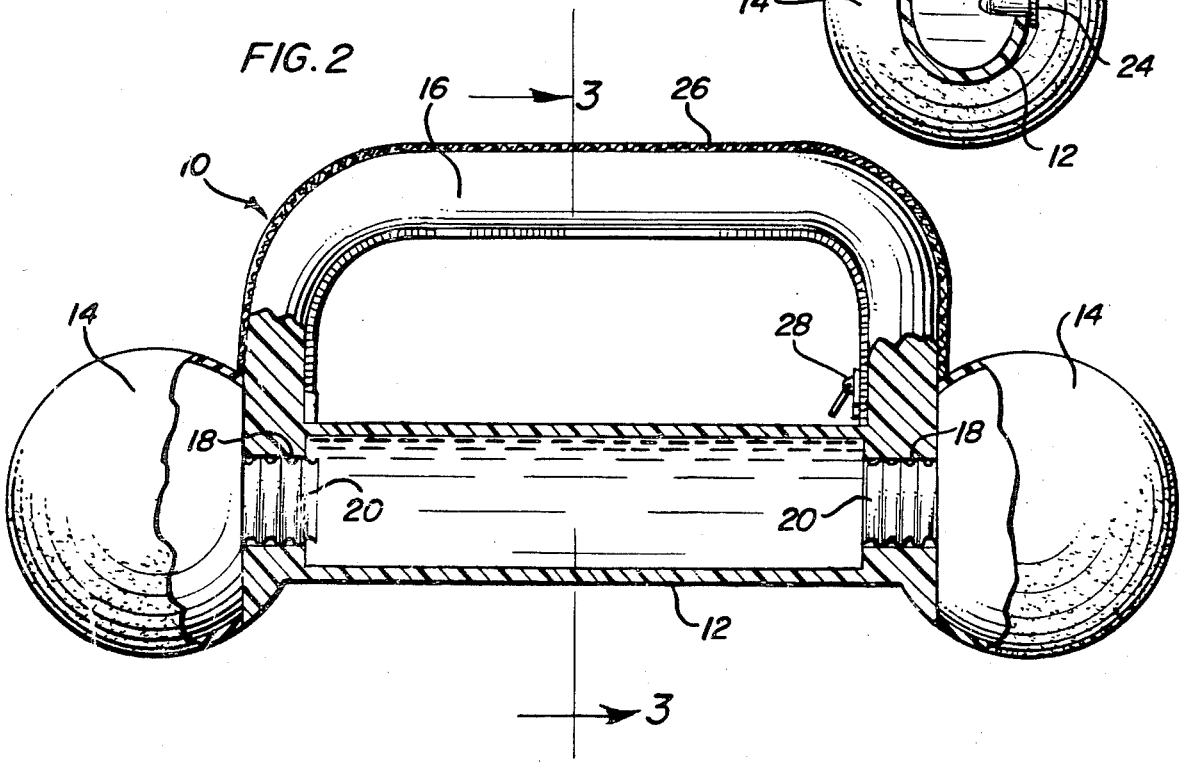
FIG. 2 is a sectional view on line 2—2 of FIG. 1.

An exercising device 10 in accordance with the invention comprises a tubular reservoir member 12, a pair of ball-shaped end caps 14 and a generally U-shaped handle member 16 extending from the opposite ends of member 12. The reservoir member 12 and handle member 16 may, for example, be integrally molded in a suitable plastic. The body of member 12 may conveniently be of oval cross section as shown in FIG. 3 and its opposite ends may be provided with female threads 18 for receipt of complementary threaded male studs 20 on the respective weighted balls 14. The weighted balls may be a pair of end caps selected from a set of such end caps which are provided with the device for selective use on tubular member 12, the set of end caps, for example, having different weight balls 14 ranging for example from one pound in weight to six pounds in weight. The capacity of reservoir 12 may be about five fluid ounces being shaped as a four and a quarter inch circumference oval hand grip.

The wall of member 12 may be provided with a drinking opening 22, see FIG. 3, which may be selectively opened and closed by means of a flap type valve 24. Accordingly, in use, it is not necessary to remove one of the end caps in order to drink from the reservoir. Handle 16 may be provided with a removable terrycloth cover 26 for absorbing perspiration, the cover being provided with a zipper 28 or like fastening means.

It will be understood that for exercising purposes, the overall weight of the device can be adjusted by selecting the respective end cap members 14 from the set provided and reservoir member 12 provides a convenient source of drinking fluid for the user while exercising.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercising device in the form of a dumbbell having a hollow cylindrical central section suited for holding in the hand, and first weighted ball-shaped ends on the cylindrical section, wherein at least one of said ends is in the form of a screw-on cap for the cylindrical section for providing access thereto so that the cylindrical section may be used as a reservoir for containing a drinking liquid, the first weighted ball-shaped ends being weighted, such that the device can be used for exercising, independent of any drinking liquid contained in the device.

2. The invention of claim 1 wherein the weighted ball-shaped ends and hollow cylindrical central section are provided such that any drinking liquid is contained in said central section and not in the weighted ball-shaped ends.

3. The invention of claim 2 including valve means in a wall of the cylindrical section for use in drinking from the device, whereby drinking liquid can be removed from the hollow cylindrical central section without removal of a weighted ball-shaped end.

4. The invention of claim 1 wherein each of the weighted ball-shaped ends is in the form of a screw-on cap for the cylindrical section, and is removable and replaceable, with respect to said central section, by other weighted ball-shaped ends of different weights, whereby the weight of the exercising device can be adjusted independently of any drinking fluid contained in the device.

5. The invention of claim 4 wherein the device includes further weighted ball-shaped ends of different weights, adapted to removably replace said first weighted ball-shaped ends, respectively enabling the overall weight of the device to be adjusted by selected use of the respective weighted ball-shaped ends on the cylindrical section.

6. The invention of claim 1 including valve means in a wall of the cylindrical section for use in drinking from the device, whereby drinking liquid can be removed from the hollow cylindrical central section without removal of a weighted ball-shaped end.

7. The invention of claim 1 including a substantially U-shaped handle member extending from the cylindrical section.

8. The invention of claim 7 wherein the handle member is provided with a removable cover of liquid-absorbing fabric.

9. A dumbbell-type exercising device comprising a hollow tubular central section for receiving a drinking liquid, and a plurality of ball-shaped end members of different weight for closing the respective ends of the tubular section and for adjusting the overall weight of the device by selected use of the respective ball-shaped members on the ends of the tubular section, the plurality of end members having such weight that the device can be used for exercising and that the weight of the device can be adjusted, independently of the quantity of drinking liquid present in the device.

10. The invention of claim 9 including a drinking valve in a wall of the tubular central section, whereby drinking liquid can be removed from the central section without removal of a ball-shaped end member.

11. The invention of claim 9 wherein the tubular section has an oval cross-section.

12. The invention of claim 9 wherein the device includes a generally U-shaped handle member extending from the tubular section.

13. The invention of claim 12 including a removable fabric cover of moisture absorbent material for the handle member.

14. The invention of claim 9 wherein the ball-shaped end members and the central section are provided such that, when the end members close the respective ends of the tubular section, any drinking liquid is contained in said central section and not in the weighted ball-shaped end members.

15. The invention of claim 14 including a drinking valve in a wall of the tubular central section, whereby drinking liquid can be removed from the central section without removal of a ball-shaped end member.

16. The invention of claim 9 wherein the ball-shaped end members are weighted, such that the device can be used for exercising, independent of any drinking liquid contained in the device.

17. The invention of claim 9 wherein the central section has threaded ends, and the ball-shaped end members are threaded so as to be removably connected to the central section.

* * * * *